US011226085B2

(12) United States Patent
Jiang

(10) Patent No.: US 11,226,085 B2
(45) Date of Patent: Jan. 18, 2022

(54) COMBINED EFFECT WHEEL DEVICE

(71) Applicant: Guangzhou Haoyang Electronic Co., Ltd., Guangzhou (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/183,911

(22) Filed: Feb. 24, 2021

(65) Prior Publication Data

US 2021/0222856 A1 Jul. 22, 2021

Related U.S. Application Data

(63) Continuation of application No. PCT/CN2020/111828, filed on Aug. 27, 2020.

(30) Foreign Application Priority Data

Jan. 19, 2020 (CN) ..... 202020111163.8

(51) Int. Cl.
*F21V 14/08* (2006.01)
*F21W 131/406* (2006.01)

(52) U.S. Cl.
CPC ..... *F21V 14/08* (2013.01); *F21W 2131/406* (2013.01)

(58) Field of Classification Search
CPC ..... F21V 14/08; F21W 2131/406
See application file for complete search history.

(56) References Cited

U.S. PATENT DOCUMENTS

2008/0055608 A1 3/2008 Bornhorst
2014/0118991 A1* 5/2014 Lin ..... G02B 26/008 362/84

FOREIGN PATENT DOCUMENTS

CN 203823666 U 9/2014
CN 109519855 A 3/2019
CN 209540748 U 10/2019
CN 211345133 U 8/2020

* cited by examiner

*Primary Examiner* — Sean P Gramling
(74) *Attorney, Agent, or Firm* — Muncy, Geissler, Olds & Lowe, P.C.

(57) ABSTRACT

The combined effect wheel device includes an effect wheel, a first driving unit configured to drive the effect wheel to rotate, and a second driving unit configured to drive the effect wheel to shift. The effect wheel includes a multiple of light transmission rings surrounding a disk body center of the effect wheel, each of the light transmission rings has an effect zone for generating light effects, and at least two light transmission rings are provided with light through holes that allow beams to pass though freely. The light through hole closest to a light path can be switched to the light path by the first driving unit and the second driving unit, thereby greatly reducing the switching time and switching the beam effect of stage lights more coherently.

9 Claims, 2 Drawing Sheets

PRIOR ART

COMBINED EFFECT WHEEL DEVICE

CROSS REFERENCE TO RELATED APPLICATIONS

The present application is a continuation of International Application No. PCT/CN2020/111828, filed on Aug. 27, 2020, which claims priority from Chinese Patent Application No. 202020111163.8 filed on Jan. 19, 2020, all of which are hereby incorporated herein by reference.

TECHNICAL FIELD

The invention relates to the technical field of stage lights, in particular to a combined effect wheel device and a stage light including the same.

BACKGROUND

With continuous development of stage light technologies, one or more effects like color, pattern, light splitting are usually integrated into a combined effect wheel to form multiple light transmission rings so as to realize functional diversification of stage lights, which meets the requirements of small size and compact internal structure. However, conventional combined effect wheels generally have only one light through hole, as shown in FIG. 1. When it is necessary to switch from an effect zone to the light through hole to allow a beam to pass through freely, if a position where the effect zone crosses the beam is distant from the light through hole, the effect wheel needs to be rotated or shifted for a long time, causing an intermediate transition state of effect switch, which is easy to feel for the audience, thereby affecting user's experience.

SUMMARY

The invention provides a combined effect wheel device that greatly reduces switch time when the effect wheel is switched from an effect zone to a light through hole, resulting coherent beam effect switch of stage lights.

According to the present invention, the combined effect wheel device includes an effect wheel, a first driving unit configured to drive the effect wheel to rotate, and a second driving unit configured to drive the effect wheel to shift. The effect wheel includes a multiple of light transmission rings, each light transmission ring being surrounding a center of the effect wheel, each of the light transmission rings has an effect zone for generating a light effect, and a light through hole is provided for at least two light transmission rings that allows light beams to pass though freely.

By the configuration that a light through hole is provided for at least two light transmission rings, when a portion where the effect wheel crosses a light path needs to be switched from the effect zone to one light through hole, the light through hole closest to the light path can be driven to switch to the light path by the first driving unit and the second driving unit, thereby greatly reducing the switch time and switching the beam effect of the stage lights more coherently. What's more, the first driving unit drives the effect wheel to rotate around its own axis, which can achieve a switch among different positions of the effect zone on the same light transmission ring, or a switch between the effect zone and the light through hole. The second driving unit drives the effect wheel to shift as so to realize a switch between different light transmission rings.

According to a preferable embodiment, each of the light transmission rings is provided with a light through hole that allows the light beam to pass through freely. In such configuration, when the portion where the effect wheel crosses the light path is switched from the effect zone to the light through hole, the effect wheel can choose to rotate the light through hole to the light beam position only by rotating around its own axis, or select to rotate the nearest light through hole on the other light transmission rings to intersect the light beam by simultaneously rotating around its own axis and shifting, so that the switch time of the effect wheel can be further reduced, and an entire control program is relatively simple for a control software.

The light through holes are preferably located on a same straight line and on the same side of the center of the effect wheel. On the one hand, software positioning of the light through holes is more convenient; on the other hand, when the light beam is located exactly at a light through hole on an inner circle of the effect wheel, the effect wheel can completely switch out the light path along the straight line, which will sweep no or less effect zones.

More preferably, the light through holes on two adjacent light transmission rings communicate with each other to form an elongated through hole. Compared with light through holes that are independent of each other, mutual communication between the light through holes allows a region where the effect wheel intersects the light path to be switched from a light through hole on one light transmission ring to a light through hole on the other adjacent light transmission ring without any obstruction and transition image.

According to one embodiment of the present invention, the combined effect wheel device also includes a bracket and a moving plate. The moving plate is slidably disposed on a sliding rail of the bracket, and the effect wheel is pivotally connected to the moving plate. The device is simple in structure, and convenient for processing, assembly and disassembly. Rotation movement and shift movement of the effect wheel will not affect each other, and can be performed simultaneously or independently.

Specifically, the first driving unit includes a first motor mounted on the moving plate, a first driving wheel connected to a rotating shaft of the first motor, and a first pulley pivotally connected to the moving plate. The first pulley is connected to the first driving wheel through a first belt, and the effect wheel is fixed to the first pulley. The first motor drives the first driving wheel to rotate, and the first driving wheel drives the first pulley to rotate through the first belt, thereby driving the effect wheel fixed to the first pulley to rotate. Compared with a direct connection between the effect wheel and the rotating shaft of the first motor, i.e., gear transmission, the effect wheel is driven by means of belt transmission, so that a height space of the first driving unit in a light beam direction is saved, and the belt transmission occupies a smaller space in a direction perpendicular to the beam direction compared to gear transmission.

Further, the second driving unit includes a second motor mounted on the bracket, a second driving wheel fixed to a rotating shaft of the second motor, and a second pulley pivotally connected to the bracket. The second driving wheel is connected to the second pulley through a second belt, and the moving plate is fastened to the second belt and is driven by the second belt to slide on the sliding rail. The second motor drives the second driving wheel to rotate, the second driving wheel and the second pulley are driven by the second belt, and the moving plate is driven by the second belt to shift along the sliding rail, thereby driving the effect wheel pivotally connected to the moving plate to shift.

According to one embodiment of the present invention, each effect zone of each light transmission ring includes one or more of pattern effect, color effect, filter effect, light splitting effect, and fogging effect. Different effect zones can be set according to actual requirements, so that the beam effect of stage lights is more diverse. The pattern effect can cause a light beam that passes through to project a particular static pattern or dynamic pattern. The color effect can change a color of a light beam that passes through. The filter effect can filter a light beam that passes through to change color temperature, color rendering index and the like of the beam. The light splitting effect can cause a light beam that passes through to project multiple light beams. The fogging effect can cause a beam that passes through to become more uniform and softer.

According to one embodiment of the present invention, the effect zone on each light transmission ring is composed of several spaced-apart effect regions. The effect regions are spaced at intervals to facilitate disassembly and replacement of a single effect region in the future.

The present invention also provides a stage light including a light source and the above-mentioned combined effect wheel device. The light emitted by the light source passing through the combined effect wheel device can project rich stage lighting effects.

EMBODIMENTS

Figure 1:
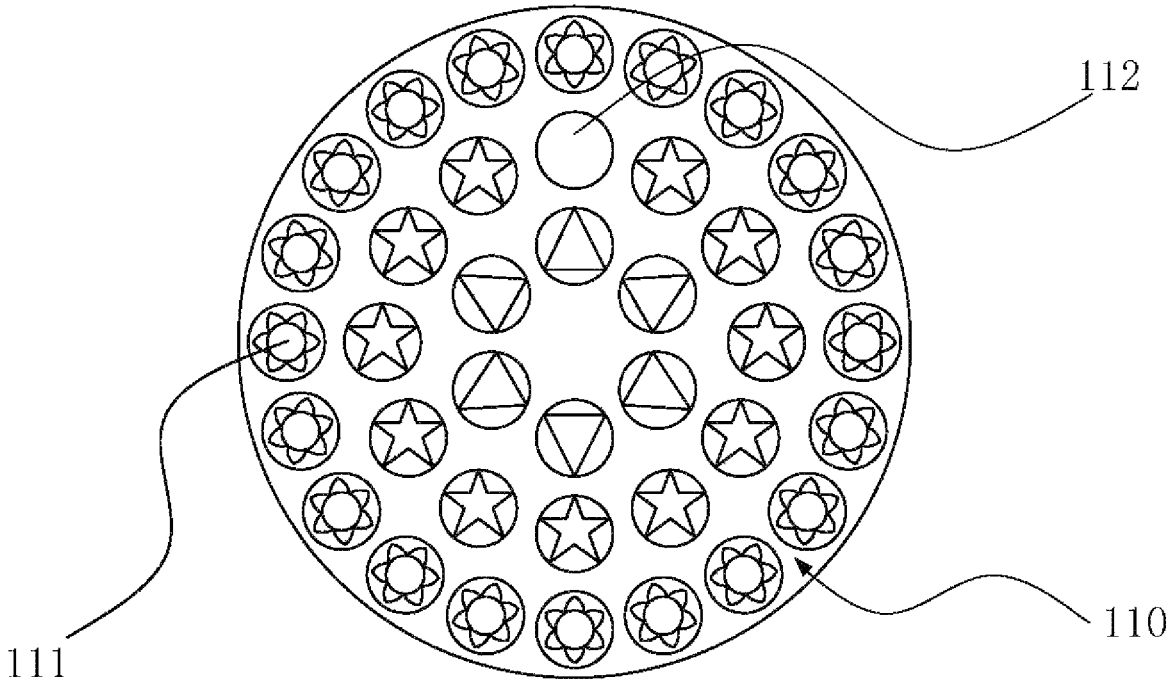
FIG. 1 is a schematic structural view of an existing effect wheel in the prior art.

The drawings of the present invention are for illustration purpose only and are not intended to limit the present invention. Some components in the drawings may be omitted, enlarged, or reduced for better illustrating the following embodiments, and sizes of these components do not represent sizes of actual products. For those skilled in the art, it will be understood that some known structures and descriptions thereof in the drawings may be omitted. The positional relationships in the drawings are for illustration purpose only and are not intended to limit the present invention.

Figure 2:
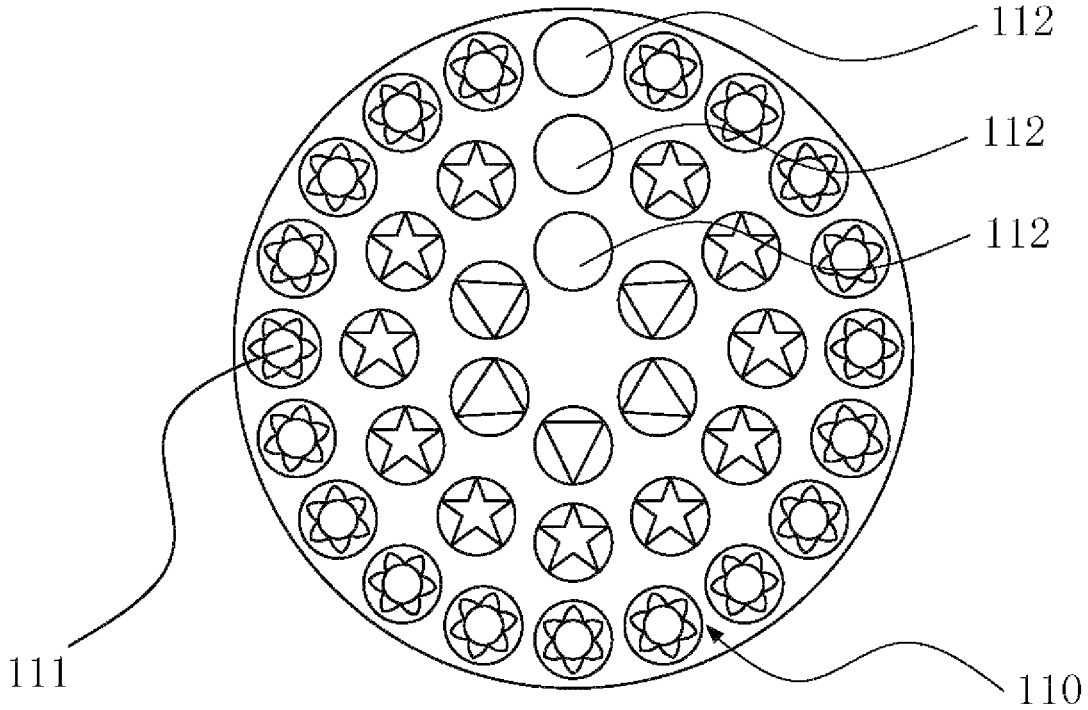
FIG. 2 is a schematic structural view of a combined effect wheel according to an embodiment of the present invention.
Figure 4:
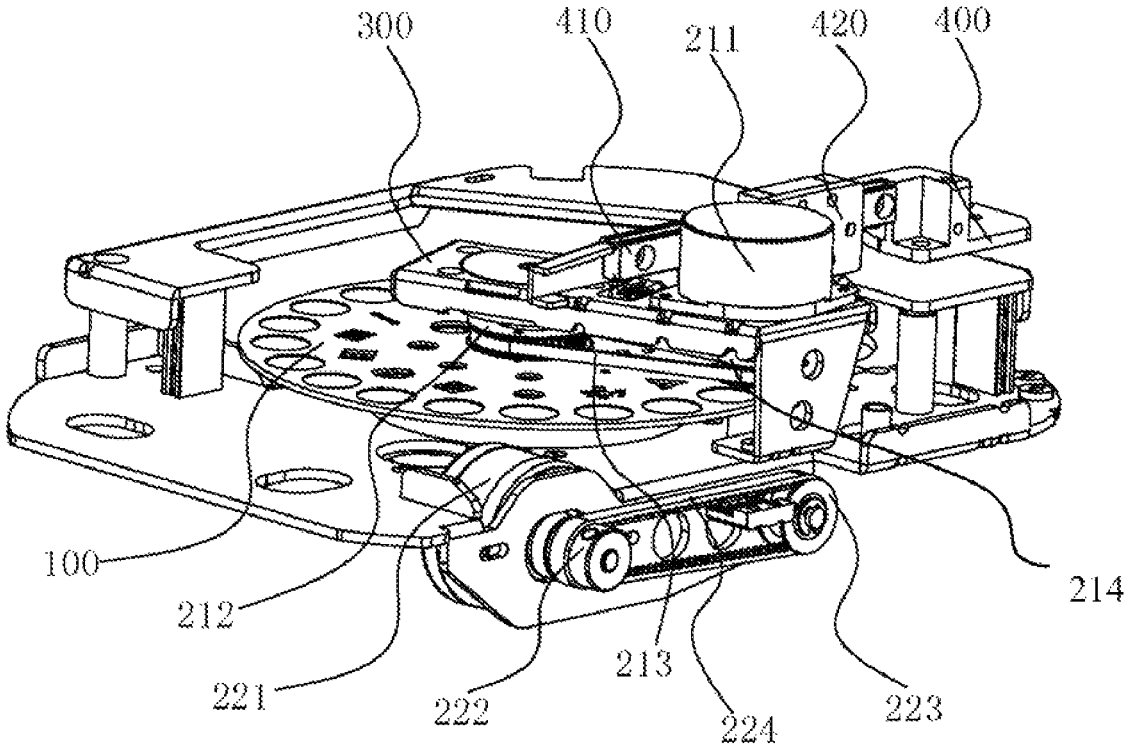
FIG. 4 is a schematic exploded view of the combined effect wheel according to an embodiment of the present invention.

As shown in FIGS. 2 and 4, the present embodiment provides a combined effect wheel device comprising an effect wheel 100, a first driving unit configured to drive the effect wheel 100 to rotate, and a second driving unit configured to drive the effect wheel 100 to shift. The effect wheel 100 includes a multiple of light transmission rings 110, each of the light transmission rings being surrounding a center of the effect wheel 100, each of the light transmission rings 110 has an effect zone for generating a light effect, and at least two light transmission rings 110 are provided with a light through hole 112 that allows light beams to pass though freely.

By the configuration that a light through hole 112 is provided for at least two light transmission rings 100, when a portion where the effect wheel 100 crosses a light path needs to be switched from the effect zone to the light through hole 112, the light through hole 112 closest to the light path can be driven to switch to the light path by the first driving unit and the second driving unit, thereby greatly reducing switch time and switching a beam effect of stage lights more coherently. What's more, the first driving unit drives the effect wheel 100 to rotate around its own axis, which can achieve a switch among different positions of the effect zone on the same light transmission ring 110 or a switch between the effect zone and the light through hole 112. The second driving unit drives the effect wheel 100 to shift to realize a switch between different light transmission rings 110. It should be noted that "shift" herein refers to that the effect wheel 100 can achieve a switch between different light transmission rings 110 in a panning movement or tilting movement. In the present embodiment, the effect wheel 100 achieves the switch between different light transmission rings 110 in panning movement.

As shown in FIG. 2, according to the present embodiment, each of the light transmission rings 110 is provided with a light through hole 112 that allows the light beam to pass through freely. In such configuration, when a portion where the effect wheel 100 crosses the light path is switched from the effect zone to the light through hole 112, the effect wheel 100 can choose to rotate the light through hole 112 to the light beam position only by rotating around its own axis, or select to rotate the nearest light through hole 112 on the other light transmission rings 110 to intersect the light beam by simultaneously rotating and shifting, so that the switch time of the effect wheel 100 is further reduced, and an entire control program is relatively simple for a control software.

As shown in FIG. 2, according to the present embodiment, the light through holes 112 are located on the same straight line and on the same side of the center of the effect wheel 100. On the one hand, software positioning of the light through holes 112 is more convenient; on the other hand, when the light beam is located exactly at a light through hole 112 on an inner circle of the effect wheel 100, the effect wheel 100 can completely switch out the light path along the straight line, which will sweep no or less effect zones 110. In this embodiment, the effect wheel 100 has three light transmission rings 110, each of the light transmission rings 110 has a light through hole 112, and the light through holes 112 are on the same straight line.

Referring to FIG. 4, the combined effect wheel device also includes a bracket 400 and a moving plate 300. The moving plate 300 is slidably disposed on a sliding rail 410 of the bracket 400, and the effect wheel 100 is pivotally connected to the moving plate 300. The device in such configuration is simple in structure, and convenient for processing, assembly and disassembly. Rotation movement and shift movement of the effect wheel 100 do not affect each other, and can be performed simultaneously or independently. A length of the sliding rail 410 can be determined according to actual requirements, preferably equal to a linear distance from a center of the effect wheel 100 to a periphery of the effect wheel 100.

The first driving unit includes a first motor 211 mounted on the moving plate 300, a first driving wheel 214 fixed to a rotating shaft of the first motor 211, and a first pulley 212 pivotally connected to the moving plate 300. The first pulley 212 is connected to the first driving wheel 214 through a first belt 213, and the effect wheel 100 is fixed to the first pulley 212. The first motor 211 drives the first driving wheel 214 to rotate, and the first driving wheel 214 in turn drives the first pulley 212 to rotate through the first belt 213, thereby driving the effect wheel 100 fixed to the first pulley 212 to rotate. Compared with a direct connection between the effect wheel 100 and the rotating shaft of the first motor 211, i.e., gear transmission, the effect wheel 100 is driven by means of belt transmission, so that a height space of the first driving unit in a light beam direction is saved, and the belt transmission occupies a smaller space in a direction perpendicular to the beam direction compared to gear transmission. In this embodiment, the moving plate 300 extends downwardly a central axis that is pivotally connected with the first pulley 212, and the effect wheel 100 is fixed on the first pulley 212, so that an axle center of the central axis coincides with the center of the effect wheel 100.

Alternatively, the first driving wheel 214 can be engaged directly with the first pulley 212 or can be driven by rack gear, chain gear, or the like.

According to the present invention, the second driving unit includes a second motor 221 mounted on the bracket 400, a second driving wheel 222 fixed to a rotating shaft of the second motor 221, and a second pulley 223 pivotally connected to the bracket 400. The second driving wheel 222 is connected to the second pulley 223 through a second belt 224, and the moving plate 300 is fastened to the second belt 224 and is driven by the second belt 224 to slide on the sliding rail 410. The second motor 221 drives the second driving wheel 222 to rotate, the second driving wheel 222 and the second pulley 223 are driven by the second belt 224, and the moving plate 300 is driven by the second belt 224 to shift along the sliding rail 410, thereby driving the effect wheel 100 pivotally connected to the moving plate 300 to shift. In the present embodiment, the moving plate 300 is compressed against the second belt 224 through two plates located above and below the second belt 224.

Alternatively, the second driving wheel 222 and the second pulley 223 can be driven by rack gear and chain gear.

Preferably, the sliding rail 410 is provided with a sliding block 420 that can slide along the sliding rail 410, the sliding block 420 is fixed to the moving plate 300, and the moving plate 300 passes through a gap between the sliding rail 410 and the bracket 400. The gap between the sliding rail 410 and the bracket 400 is fully utilized to provide more space for other components. And the shifting of the moving plate 300 can be smoother and steadier by the sliding block 420.

According to a preferred embodiment of the present invention, the effect zone of each light transmission ring includes one or more of pattern effect, color effect, filter effect, light splitting effect, and fogging effect. Different effect zones can be set according to actual requirements, so that the beam effect of stage lights is more diverse. The pattern effect can cause a light beam that passes through to project a particular static pattern or dynamic pattern. The color effect can change a color of a light beam that passes through. The filter effect can filter a light beam that passes through to change color temperature, color rendering index and the like of the beam; the light splitting effect can cause a light beam that passes through to project multiple beams. And the fogging effect can cause a light beam that passes through to become more uniform and softer. The dynamic pattern refers to allowing a light beam that passes through to project an effect similar to an animation, and forming a dynamic effect of flames, flowing water, floating clouds, and stars during rotation.

Alternatively, the effect zones on the same light transmission ring 110 can be composed of the same effect or different effects. And the effect zones on different light transmission rings 110 can be composed of the same effect or different effects.

According to a preferred embodiment of the present invention, the effect zone on each light transmission ring 110 is composed of several effect regions 111 that are spaced from one another. The effect regions 111 are spaced at intervals to facilitate disassembly and replacement of a single effect region 111 in the future. The effect region 111 can be formed by fixing an effect sheet on the effect wheel 100, or can also be formed by directly engraving various effects on the disk body of the effect wheel 100. Preferably, the effect regions 111 are uniformly distributed along the effect zone.

Alternatively, the effect zone of each light transmission ring 110 can be composed of continuous effect regions 111. It also can be that part of the effect regions 111 in a single effect zone is continuous, and the other part of the effect regions 111 is discontinuous.

Figure 3:
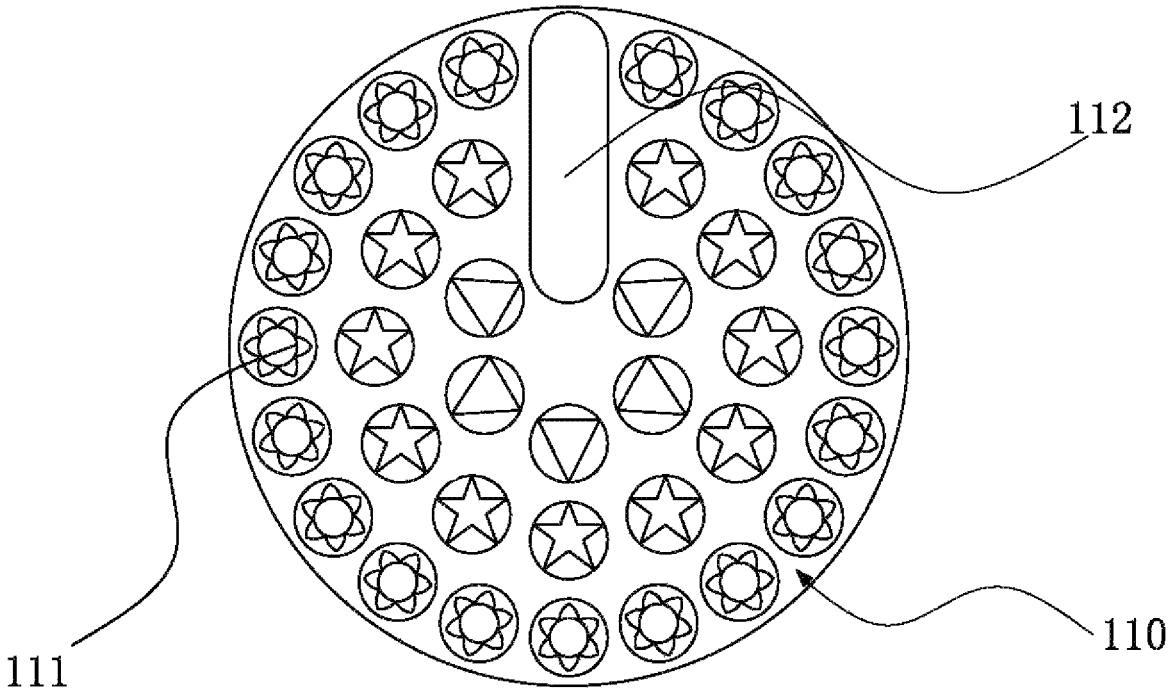
FIG. 3 is a schematic structural view of the combined effect wheel according to another embodiment of the present invention.

FIG. 3 shows a combined effect wheel according to another embodiment, the light through holes 112 on two adjacent light transmission rings 110 communicate with each other to form an elongated through hole. Compared with light through holes 112 that are independent of each other, mutual communication between the light through holes 112 allows a region where the effect wheel 100 intersects the light path to be switched from a light through hole 112 on a light transmission ring 110 to a light through hole 112 on the other adjacent light transmission ring 110 without any obstruction and transition image.

The present invention also provides a stage light including a light source and the above-mentioned combined effect wheel device. The light emitted by the light source passing through the combined effect wheel device 100 can project rich stage lighting effects.

Obviously, the above embodiments of the present invention are merely examples for clear illustration of the present invention, and are not intended to limit the implementation of the present invention. Any modification, equivalent substitution or improvement and the like within the spirit and principle of the claims of the present invention should be included in the scope of claims of the present invention.

The invention claimed is:

1. A combined effect wheel device, comprising:

an effect wheel;

a first driving unit configured to drive the effect wheel to rotate;

a second driving unit configured to drive the effect wheel to shift;

a bracket; and a moving plate, wherein the moving plate is slidably disposed on a sliding rail of the bracket, and the effect wheel is pivotally connected to the moving plate, and wherein the effect wheel includes a multiple of light transmission rings, each of the multiple of light transmission rings being surrounding a center of the effect wheel, each of the multiple of the light transmission rings has an effect zone configured to generate a light effect, and at least two light transmission rings are provided with a light through hole that allows a light beam to pass though freely.

2. The combined effect wheel device according to claim 1, wherein each of the multiple of the light transmission rings is provided with the light through hole that allows the light beam to pass through freely.

3. The combined effect wheel device according to claim 2, wherein the light through hole of each of the multiple of the light transmission rings is located on a straight line and on one side of the center of the effect wheel.

4. The combined effect wheel device according to claim 3, wherein the light through holes of two adjacent light transmission rings communicate with each other to form an elongated through hole.

5. The combined effect wheel device according to claim 1, wherein the first driving unit includes:

a first motor mounted on the moving plate;

a first driving wheel fixed to a rotating shaft of the first motor; and a first pulley pivotally connected to the moving plate, wherein the first pulley is connected to the first driving wheel through a first belt, and the effect wheel is fixed to the first pulley.

6. The combined effect wheel device according to claim 1, wherein the second driving unit includes:

a second motor mounted on the bracket;

a second driving wheel fixed to a rotating shaft of the second motor; and a second pulley pivotally connected to the bracket, wherein the second driving wheel is connected to the second pulley through a second belt, and the moving plate is fastened to the second belt and is driven by the second belt to slide on the sliding rail.

7. The combined effect wheel device according to claim 1, wherein the effect zone of each light transmission ring includes one or more of pattern effect, color effect, filter effect, light splitting effect, and fogging effect.

8. The combined effect wheel device according to claim 1, wherein the effect zone of each light transmission ring is composed of several spaced-apart effect regions.

9. A stage light, comprising:

a light source; and a combined effect wheel device according to claim 1.

* * * * *